US012644249B2

(12) United States Patent
Geiger

(10) Patent No.: US 12,644,249 B2
(45) Date of Patent: Jun. 2, 2026

(54) WALKING EXCAVATOR

(71) Applicant: Kaiser Aktiengesellschaft, Schaanwald (LI)

(72) Inventor: René Geiger, Au (CH)

(73) Assignee: Kaiser Aktiengesellschaft, Schaanwald (LI)

( * ) Notice: Subject to any disclaimer, the term of this patent is extended or adjusted under 35 U.S.C. 154(b) by 1125 days.

(21) Appl. No.: 17/672,789

(22) Filed: Feb. 16, 2022

(65) Prior Publication Data

US 2022/0267982 A1 Aug. 25, 2022

(30) Foreign Application Priority Data

Feb. 23, 2021 (AT) ..... GM 17/2021

(51) Int. Cl.

| | |
|---|---|
| ***E02F 3/32*** | (2006.01) |
| ***E02F 9/08*** | (2006.01) |
| ***E02F 9/20*** | (2006.01) |
| ***E02F 9/22*** | (2006.01) |

(52) U.S. Cl.

CPC ..... *E02F 3/32* (2013.01); *E02F 9/08* (2013.01); *E02F 9/2058* (2013.01); *E02F 9/22* (2013.01)

(58) Field of Classification Search

CPC ... E02F 3/32; E02F 9/08; E02F 9/0258; E02F 9/22

See application file for complete search history.

(56) References Cited

U.S. PATENT DOCUMENTS

| | | | | |
|---|---|---|---|---|
| 4,049,070 A * | 9/1977 | Soyland | ..... | E02F 9/02 180/8.5 |
| 4,265,326 A * | 5/1981 | Lauber | ..... | E02F 9/04 180/8.3 |
| 4,360,311 A * | 11/1982 | Dufour | ..... | E02F 9/20 180/41 |
| 6,443,687 B1 * | 9/2002 | Kaiser | ..... | E02F 9/024 180/209 |

(Continued)

FOREIGN PATENT DOCUMENTS

| | | |
|---|---|---|
| DE | 3120110 | 2/1982 |
| DE | 102010023435 | 12/2011 |

(Continued)

*Primary Examiner* — Saul Rodriguez
*Assistant Examiner* — Brendan P Tighe
(74) *Attorney, Agent, or Firm* — Volpe Koenig

(57) ABSTRACT

A walking excavator (1) having a superstructure (2) and an undercarriage (29), and a cab (3) disposed on the superstructure (2), and four walking legs (4) pivotably disposed on the undercarriage (29), and an excavator arm (5) which is pivotably mounted on the superstructure (2) and to which an excavating tool (6), in particular an excavator bucket, is fastened or able to be fastened. A dual-action differential cylinder (7) pivots the excavator arm (5) up and down relative to the superstructure (2) and is articulated on the superstructure (2), on one side, and on the excavator arm (5), on an other side. For applying additional force along with the dual-action differential cylinder (7) when pivoting the excavator arm (5) down relative to the superstructure (2), a single-action differential cylinder (8) is additionally articulated on the superstructure (2), on one side, and on the excavator arm (5), on an other side.

12 Claims, 3 Drawing Sheets

(56) References Cited

U.S. PATENT DOCUMENTS

| | | | | |
|---|---|---|---|---|
| 7,198,278 | B2 * | 4/2007 | Donaldson | B62D 49/08 180/209 |
| 9,174,488 | B2 * | 11/2015 | Berry | B60B 35/10 |
| 10,562,364 | B2 * | 2/2020 | Crook | B62D 5/26 |
| 10,850,963 | B2 * | 12/2020 | Hackenberg | B66F 9/07513 |
| 11,007,838 | B2 * | 5/2021 | Bowden | B66F 11/044 |
| 2006/0053666 | A1 | 3/2006 | Asam et al. | |
| 2012/0312003 | A1 | 12/2012 | Gmelin | |
| 2013/0034419 | A1 | 2/2013 | Tsukane | |
| 2016/0319513 | A1 * | 11/2016 | Chen | E02F 9/024 |

FOREIGN PATENT DOCUMENTS

| | | | | |
|---|---|---|---|---|
| DE | 102011106672 | | 1/2013 | |
| DE | 102011106672 | A1 * | 1/2013 | E02F 9/2217 |
| DE | 102015009111 | | 1/2017 | |
| EP | 1614814 | | 1/2006 | |
| EP | 2146009 | | 1/2010 | |
| JP | S60215933 | | 10/1985 | |
| JP | S60250128 | | 12/1985 | |
| JP | S63206534 | | 8/1988 | |
| KR | 20070105424 | | 10/2007 | |
| WO | 9716371 | | 5/1997 | |
| WO | 2015022054 | | 2/2015 | |

* cited by examiner

WALKING EXCAVATOR

INCORPORATION BY REFERENCE

The following documents are incorporated herein by reference as if fully set forth: Austrian Utility Application No. GM 17/2021, filed Feb. 23, 2021.

TECHNICAL FIELD

The present invention relates to a walking excavator having a superstructure and an undercarriage, and a cab disposed on the superstructure, and four walking legs pivotably disposed on the undercarriage, and an excavator arm which is pivotably mounted on the superstructure and to which an excavating tool, in particular an excavator bucket, is fastened or able to be fastened, wherein a dual-action differential cylinder for pivoting the excavator arm up and down relative to the superstructure is articulated on the superstructure, on the one hand, and on the excavator arm, on the other hand.

BACKGROUND

Walking excavators are a special type of excavator which have been conceived particularly for operating on slopes and/or on other uneven terrain. As opposed to excavators which travel on a running gear with wheels or tracks, such walking excavators have four walking legs. The latter are disposed on the undercarriage of the walking excavator. The superstructure of the walking excavator is disposed on this undercarriage. The walking legs can be individually pivoted in relation to the undercarriage so as to be able to dispose the walking excavator in positions which are favorable for the respective operating task even in uneven terrain and in particular on slopes. Wheels as well as support feet may be found on the walking legs.

In generic walking excavators, like in other excavators, it is provided that the pivoting of the excavator arm up and down relative to the superstructure is implemented by a dual-action differential cylinder which is articulated on the superstructure, on the one hand, and on the excavator arm, on the other hand. In the case of dual-action differential cylinders it is however to be considered that the maximum forces that can be made available by the respective dual-action differential cylinder are greater during deployment than the forces that can be achieved when retracting the dual-actual differential cylinder at the same hydraulic pressure. The reason therefor lies in the construction mode of a dual-action differential cylinder, as is explained further below.

Since greater forces are typically required when pivoting the excavator arm up than when pivoting the excavator arm down in the normal excavation procedure, the dual-action differential cylinders in walking excavators according to the prior art, as well as in other excavators, are typically installed such that said dual-action differential cylinders are able to provide forces that are greater when the excavator arm is pivoted up than when the excavator arm is pivoted down.

However, in walking excavators it is the case that the excavator arm is used not only for the excavation procedure per se but also for unilaterally lifting the walking excavator when traveling in the terrain. The unilateral lifting of the walking excavator, thus in particular the undercarriage thereof and the superstructure thereof having the cab disposed thereon here takes place by pivoting the excavator arm down relative to the superstructure. However, the usual installation of the dual-action differential cylinder as discussed above here has the disadvantage that when the excavator arm is pivoted down only forces which are comparatively minor are available in comparison to when the excavator arm is pivoted up.

In order for this issue to be eliminated, the use of a dual-action differential cylinder of larger dimensions is possible and expedient only to a limited extent because the lifting force when pivoting up the excavator arm would also be increased as a result and would overload the steel structure, thus the construction of the walking excavator. Moreover, a greater volumetric flow to the dual-action differential cylinder would be required in order to be able to maintain the same velocity of movements as in the dual-action differential cylinders of currently customary dimensions.

SUMMARY

It is thus an object of the invention to improve a walking excavator of the abovementioned type with a view to ideally great forces being able to be implemented when pivoting the excavator arm down relative to the superstructure and thus for unilaterally lifting the walking excavator.

In order for this issue to be solved, the invention provides that for supporting the dual-action differential cylinder when pivoting the excavator arm down relative to the superstructure, a single-action differential cylinder is additionally articulated on the superstructure, on the one hand, and on the excavator arm, on the other hand.

It is thus a fundamental concept of the invention to articulate a single-action differential cylinder on the superstructure and on the excavator arm in addition to the dual-action differential cylinder known per se, said additional single-action differential cylinder supporting the dual-action differential cylinder when pivoting the excavator arm down relative to the superstructure. It can be achieved as a result that greater forces can be made available when pivoting down the excavator arm than in the prior art, and in particular approximately equal forces can be made available as when pivoting up the excavator arm. This can be particularly positively used when unilaterally lifting the walking excavator, or the undercarriage and superstructure thereof including the cab thereof, in order for the walking excavator thus to be in each case able to travel and/or align itself optimally even in steep terrain. In this context, the dual-action differential cylinder could also be referred to as the primary cylinder, and the single-action differential cylinder additionally provided according to the invention could be referred to as an ancillary cylinder. The pivoting up of the excavator arm could also be referred to as lifting the excavator arm, and the pivoting down of the excavator arm could also be referred to as lowering the excavator arm. These terms always relate to the normal operating position in which a driver of the walking excavator sits in the cab in order to operate the walking excavator. The dual-action differential cylinder and also the single-action differential cylinder are preferably hydraulically operated.

In preferred design embodiments of the invention it is provided that the single-action differential cylinder, and thus in other words the ancillary cylinder, is able to be impinged with pressure, or in other words is impinged with pressure, exclusively when pivoting the excavator arm down relative to the superstructure. In such design embodiments, the single-action differential cylinder is thus only used when pivoting down the excavator arm, wherein it can also be provided, as will yet be explained in detail further below, that the single-action differential cylinder is not always used when pivoting down the excavator arm, but is only used selectively for supporting the dual-action differential cylinder.

As is known per se and customary in walking excavators in the prior art, it is favorably provided also in walking excavators according to the invention that the dual-action differential cylinder is disposed on a lower side of the excavator arm. Various possibilities are available for the single-action differential cylinder. It can be provided that the single-action differential cylinder is disposed on a lower side of the excavator arm. However, it can likewise also be provided that the single-action differential cylinder is disposed on an upper side of the excavator arm. It is even conceivable that more than one single-action differential cylinder is used in addition to the dual-action differential cylinder in order to support the dual-action differential cylinder when pivoting the excavator arm down relative to the superstructure. In such design embodiments, the additional single-action differential cylinders can be disposed on the upper side as well as on the lower side of the excavator arm.

As has already been explained at the outset, in preferred design embodiments it is an objective of the invention to be able to make available approximately equal maximum forces when pivoting down the excavator arm as when pivoting up the excavator arm.

It is preferably provided that the superstructure and the undercarriage are connected to one another by a continuously rotatable connection. The continuously rotatable connection is preferably a ring mount. The undercarriage could also be referred to as the chassis.

In the embodiment of the invention it is conceivable for the dual-action differential cylinder to always be supported by the single-action differential cylinder when pivoting down the excavator arm. In these variants it is preferably provided in this instance that the single-action differential cylinder, when pivoting the excavator arm down relative to the superstructure, for supporting the dual-action differential cylinder is always impinged with pressure. However, variants of the invention in which the single-action differential cylinder supports the dual-action differential cylinder when pivoting down the excavator arm only when this is required by virtue of the currently required forces are also possible. In this context, preferred variants of the invention provide that the walking excavator has a regulator valve which is actuated as a function of a pressure value measured by a pressure sensor and by way of which the single-action differential cylinder, when pivoting the excavator arm down relative to the superstructure, for supporting the double-action differential cylinder is able to be selectively impinged with pressure as a function of the measured pressure value. The term selectively here means precisely that the dual-action differential cylinder when pivoting down the excavator arm is supported by the single-action differential cylinder only when the pressure value measured by the pressure sensor is in a pre-determined range.

In order to be able to make available particularly great forces when pivoting the excavator arm down relative to the superstructure, preferred variants of the invention provide that the walking excavator has a high pressure circuit which is actuated as a function of a pressure value measured by a or the pressure sensor and by way of which the double-action differential cylinder, and preferably also the single-action differential cylinder, when pivoting the excavator arm down relative to the superstructure as a function of the measured pressure value is/are able to be impinged with a pressure that is increased in comparison to a normal pressure level. In these variants, a pressure that is higher in specific operating states than in other operating states is thus made available by the high pressure circuit, as a result of which greater forces can then also be achieved when pivoting down the excavator arm. In the case of a selective actuation, as mentioned above, it can be provided that the higher pressure level made available by the high pressure circuit is supplied only to the dual-action differential cylinder, or to the dual-action differential cylinder and to the single-action differential cylinder.

In any case, it is preferably provided that the pressure value measured by the pressure sensor is a pressure in a pressurized line which leads to a cylinder interior of the dual-action differential cylinder that is impinged for pivoting down the excavator arm.

BRIEF DESCRIPTION OF THE DRAWINGS

Further features and details will be explained in an exemplary manner hereunder in connection with exemplary embodiments of the invention. In the figures.

DETAILED DESCRIPTION

Figure 1:
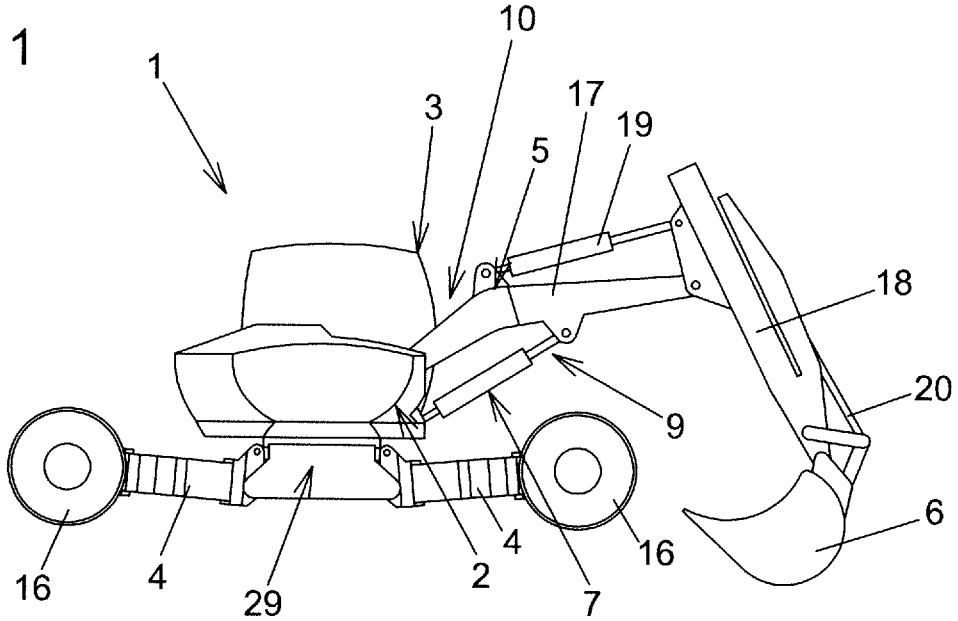
FIG. 1 schematically shows a walking excavator according to the prior art.

A walking excavator 1 known per se in the prior art is shown in a lateral view in FIG. 1. Said walking excavator 1 has a superstructure 2 on which the cab 3 is disposed. The superstructure 2 having the cab 3 is connected to the undercarriage 29 by a continuously rotatable connection. The undercarriage 29 in turn is supported on the hard ground by way of four walking legs 4. As is known per se, each of the walking legs 4 is individually pivotable in the horizontal as well as in the vertical direction, thus independently of the other three walking legs 4, this enabling a very high degree of flexibility in disposing, positioning and moving the walking excavator 1 on embankments, slopes and/or in other steep terrain. In the exemplary embodiment shown, one wheel 16 is disposed on each walking leg 4. Instead of these wheels 16, or in addition thereto, supporting feet or the like can also be attached to the walking legs 4. The wheels 16 can be driven in order for the walking excavator 1 to travel. Most varied design embodiments are known in the prior art here, which may also be used in this form in walking excavators 1 according to the invention.

Figure 5:
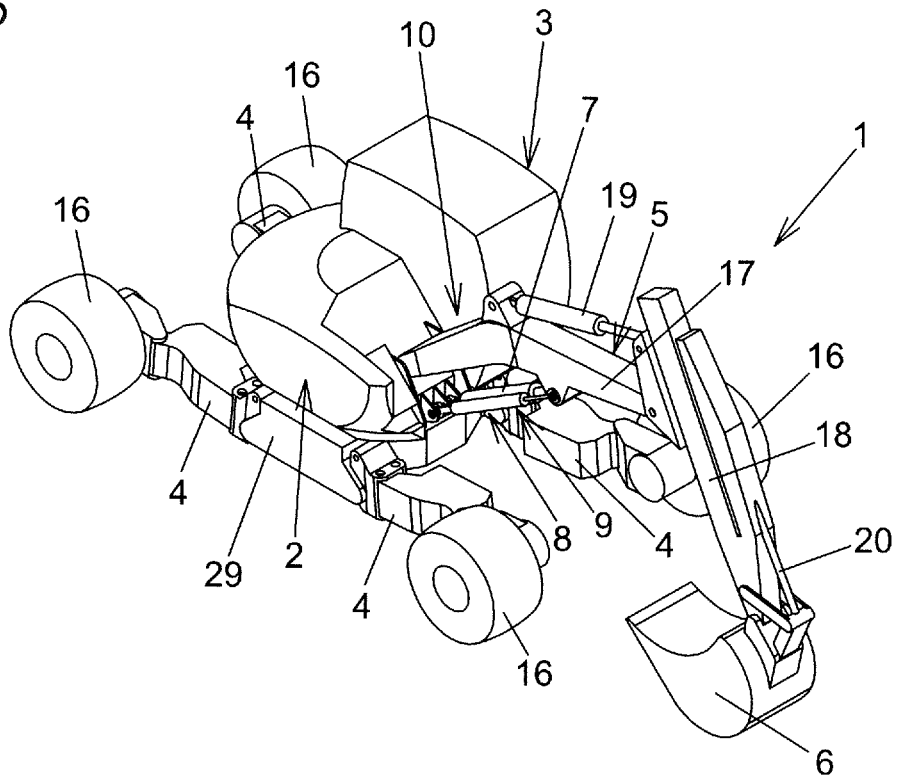
FIGS. 5 and 6 show exemplary embodiments according to the invention of walking excavators.
Figure 6:
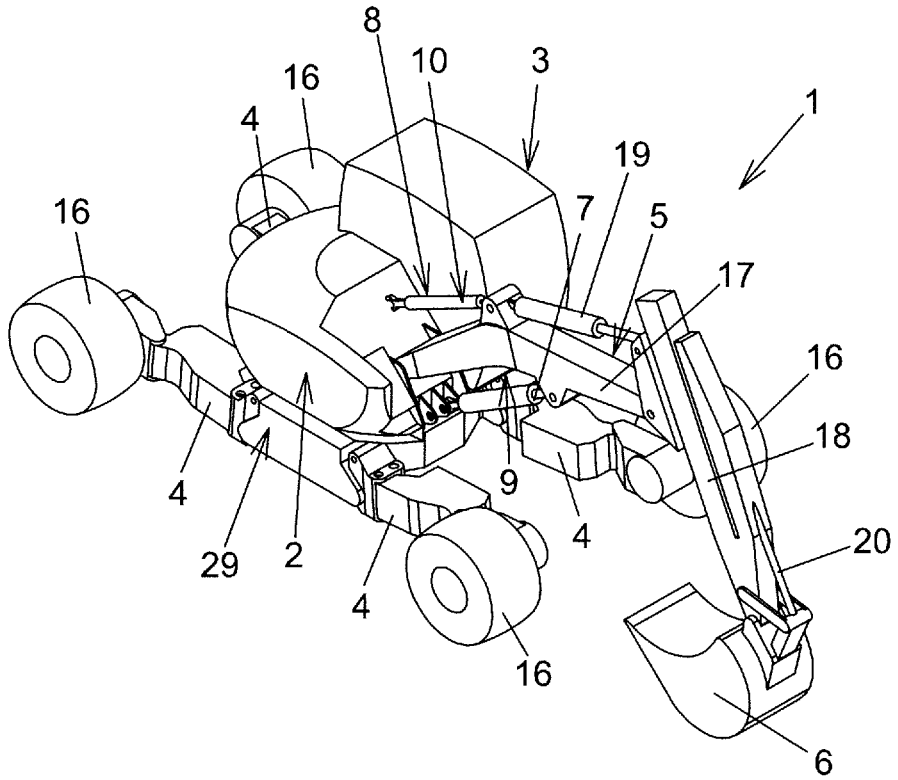

The excavator arm 5 is also pivotably mounted on the superstructure 2. The excavator arm 5 also in the case of the invention, as is shown here in FIG. 1 as well as in FIGS. 5 and 6, is preferably composed of at least two excavator arm segments 17, 18 which can be pivoted relative to one another by the pivot drive 19. The excavating tool 6, which here in FIG. 1 as well as in the illustrations of walking excavators 1 according to the invention in FIGS. 5 and 6 is embodied as an excavator bucket, is situated at the end of the excavator arm 5 that faces away from the superstructure 2 of the walking excavator 1. The excavating tool 6, here thus the excavation bucket, in walking excavators 1 according to the invention can be pivoted relative to the excavator arm 5, or relative to the excavator arm segment 18, respectively, in a manner known per se by way of the pivot drive 20. Quick assembly plates for rapid tool changes can be embodied in a manner known per se in the invention too. Of course, as is known per se in the prior art, other excavating tools 6 such as, for example, hooks, drilling tools, chisels or the like can be also attached to the excavator arm 5 instead of the excavator bucket shown here in walking excavators 1 according to the invention. To the extent that this can be implemented conjointly with the configurations of the drive for the excavator arm 5 according to the invention as will be discussed hereunder, the excavator arm 5 of walking excavators 1 according to the invention can be embodied in most varied design embodiments known per se. The dual-action differential cylinder 7 and the single-action differential cylinder 8 in the invention are favorably articulated on the excavator arm segment 17 which is articulated on the superstructure 2 of the walking excavator 1.

In the prior art, the dual-action differential cylinder 7 illustrated in FIG. 1 is used for pivoting the excavator arm 5 up relative to the superstructure 2 as well as for pivoting the excavator arm 5 down relative to the superstructure 2. To this end, said dual-action differential cylinder 7 is articulated so as to be pivotable on the superstructure 2, on the one hand, and on the excavator arm 5, on the other hand.

Figure 2:
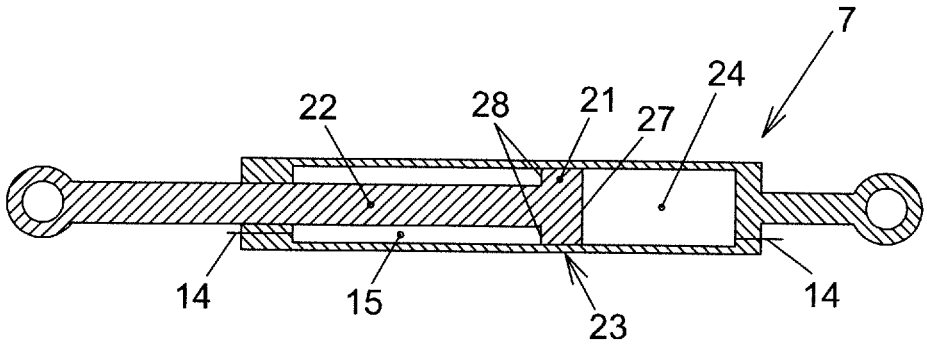
FIG. 2 shows a schematic illustration pertaining to a dual-action differential cylinder.

FIG. 2 schematically shows a dual-action differential cylinder 7 as is used in the prior art and can also be used in the invention. The dual-action differential cylinder 7 illustrated in FIG. 2 has a cylinder 23 in which a piston 21 disposed on a piston rod 22 is displaceably mounted. The piston 21 divides the interior of the cylinder 23 into the rod-proximal cylinder chamber 15 and the base-proximal cylinder chamber 24. When the base-proximal cylinder chamber 24 by way of the pressurized line 14 is impinged with pressure, the pressure in the cylinder chamber 24 acts on the entire base area 27. In contrast, when the pressure in the rod-proximal cylinder chamber 15 is built up by way of the pressurized line 14, this pressure acts only on the piston area 28 reduced by the piston rod 22, this resulting in the fact that the force made available for the movement of the excavator arm 5 when impinging the base-proximal cylinder chamber 24 in such dual-action differential cylinders 7 is greater than when the rod-proximal cylinder interior 15 is impinged with the same pressure. This is known per se and a central feature of all dual-action differential cylinders 7. By virtue of the fact that the rod-proximal cylinder interior 15 as well as the base-proximal cylinder chamber 24 can be impinged with pressure by way of the corresponding pressurized line 14, such differential cylinders illustrated in an exemplary manner in FIG. 2 are referred to as dual-action differential cylinders 7.

The installation of such dual-action differential cylinders 7 below the excavator arm 5 always has the consequence that greater forces are made available by the dual-action differential cylinder 7 when pivoting up the excavator arm 5 than when pivoting down the excavator arm 5 at identical operating pressures.

In order to now achieve a possibility with a view to being able to make available equal forces also when pivoting down the excavator arm 5, and thus when unilaterally lifting the walking excavator 1, or the undercarriage 29 and superstructure 2 including cab 3, respectively, using the excavator arm 5, the invention now provides that for supporting the dual-action differential cylinder 7 when pivoting the excavator arm 5 down relative to the superstructure 2, a single-action differential cylinder 8 is additionally articulated on the superstructure 2, on the one hand, and on the excavator arm 5, on the other hand. In other words, the single-action differential cylinder 8 as an ancillary cylinder in the invention is thus used in addition to a dual-action differential cylinder 7 acting as a primary cylinder when pivoting the excavator arm 5 down relative to the superstructure 2. As a result of this support by the single-action differential cylinder 8, correspondingly great forces can also be provided when pivoting the excavator arm 5 down relative to the superstructure 2.

Figure 3:
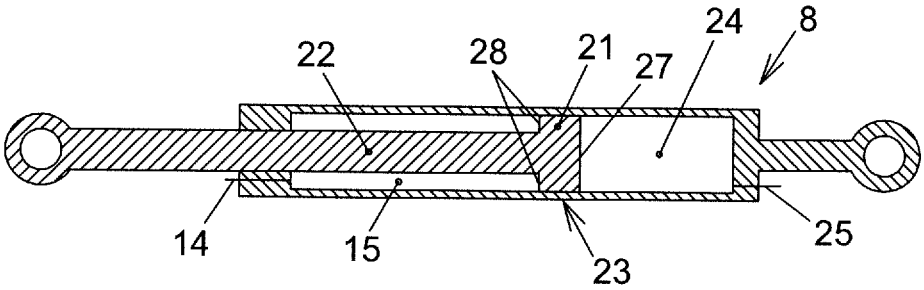
FIGS. 3 and 4 show schematic illustrations pertaining to two different variants of a single-action differential cylinder.
Figure 4:
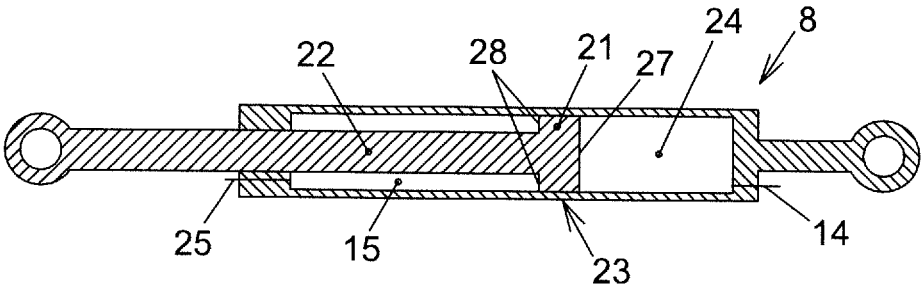

FIGS. 3 and 4 show schematic illustrations pertaining to how such single-action differential cylinders 8 can be configured. The latter also have a piston 21 which is displaceably mounted in the cylinder 23 and to which a piston rod 22 is fastened on one side. Here too, the piston 21 divides the internal volume of the cylinder 23 into a rod-proximal cylinder chamber 15 and a base-proximal cylinder chamber 24. As opposed to the dual-action differential cylinder 7 according to FIG. 2, however, it is provided in single-action differential cylinders 8 that only one of the cylinder interiors 15 or 24 can be impinged with pressure by way of a corresponding pressurized line 14, while the respective other cylinder interior 15 or 24, respectively, by way of a ventilation opening 25 is in each case connected to the environment. In single-action differential cylinders 8, as illustrated in an exemplary manner in FIGS. 3 and 4, only one of the cylinder chambers 15 or 24 can thus be impinged with pressure so that the single-action differential cylinder 8 can apply force only in one direction and cannot perform any work in the other direction.

Two exemplary embodiments according to the invention of walking excavators 1 are now schematically shown in FIGS. 5 and 6. With the exception of the differences mentioned, said exemplary embodiments can be configured like walking excavators 1 according to the prior art and as shown in FIG. 1, for example. The potential design embodiments as are known per se in the prior art are not discussed in more detail here, and reference is made to the preceding description pertaining to FIG. 1. However, as opposed to the prior art, the dual-action differential cylinder 7 which is in each case present in the invention in the walking excavators 1 according to the invention and according to FIGS. 5 and 6, when pivoting the excavator arm 5 down relative to the superstructure 2 is supported by a single-action differential cylinder 8 which is additionally present. The single-action differential cylinder 8, used as an ancillary cylinder so to speak, in both exemplary embodiments is articulated on the superstructure 2, on the one hand, and on the excavator arm 5, or the excavator arm segment 17 of the latter, respectively, on the other hand. In the exemplary embodiment according to FIG. 5, the dual-action differential cylinder 7 as well as the single-action differential cylinder 8, the latter being additionally present, are disposed on the lower side 9 of the excavator arm 5. In order for the excavator arm 5 to be pivoted up, the base-proximal cylinder chamber 24 of the dual-action differential cylinder 7 is impinged with pressure, as is known per se. The single-action differential cylinder 8 does not perform any work when pivoting up the excavator arm 5. In order for the excavator arm 5 to be pivoted down, the rod-proximal cylinder interiors 15 in the dual-action differential cylinder 7 as well as in the single-action differential cylinder 8 in each case are impinged with pressure. As a result, by virtue of the invention, in the case of a corresponding basic design, practically equal forces can be applied when pivoting down the excavator arm 5 as when pivoting up the excavator arm 5.

In the exemplary embodiment according to the invention and according to FIG. 6, the dual-action differential cylinder 7 is disposed on the lower side 9 of the excavator arm 5, as before. In contrast, the single-action differential cylinder 8 supporting said dual-action differential cylinder 7 when pivoting down the excavator arm 5 is situated on the upper side 10 of the excavator arm 5. In this exemplary embodiment, for supporting the dual-action differential cylinder 7 when pivoting down the excavator arm 5, the base-proximal cylinder chamber 24 of the single-action differentials cylinder 8 is impinged with pressure. Also in this exemplary embodiment, only the dual-action differential cylinder 7 performs work when pivoting up the excavator arm 5.

The variant of the single-action differential cylinder 8 according to FIG. 3 is thus used in FIG. 5, while a single-action differential cylinder 8, as is illustrated in an exemplary manner in FIG. 4, can be used in FIG. 6.

Figure 7:
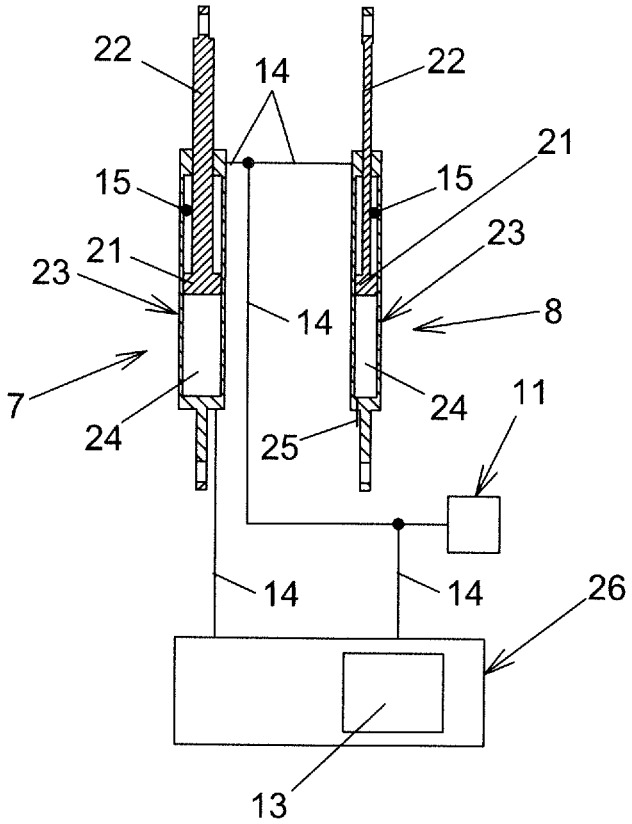
FIGS. 7 and 8 show schematic illustrations pertaining to different variants how the dual-action differential cylinder and the single-action differential cylinder can be impinged with pressure.
Figure 8:
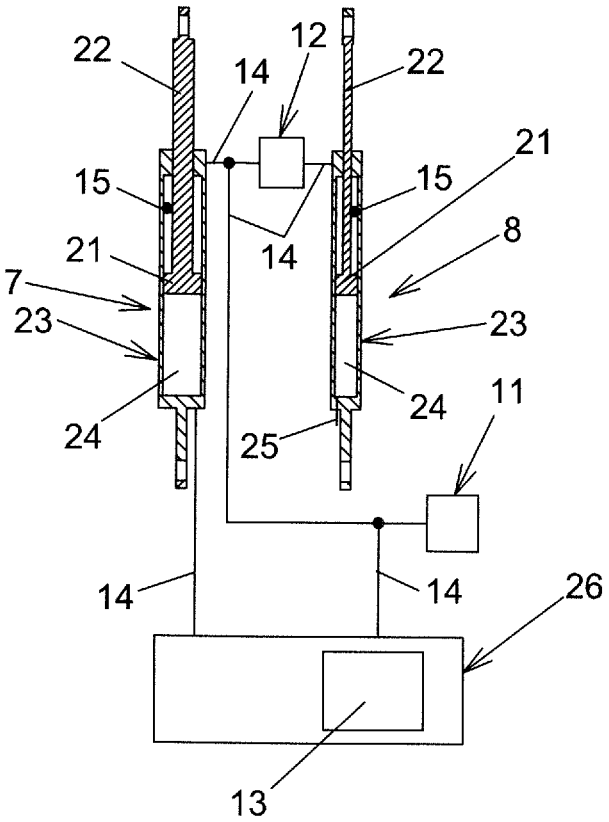

FIGS. 7 and 8 now show two simplified diagrams illustrating how the dual-action differential cylinder 7 and the single-action differential cylinder 8 for pivoting up and for pivoting down the excavator arm 5 can be impinged with pressure by way of the pressurized lines 14. Such pressure diagrams are usually embodied in the form of hydraulic systems also in the case of the invention.

The pressure control unit 26, which here is illustrated only in a very simplified manner, comprises a corresponding pressure source and corresponding control valves by way of which the pressurized lines 14 can be selectively impinged with pressure. In order for the excavator arm 5 to be pivoted up relative to the superstructure 2, only the pressurized line 14 which leads to the base-proximal cylinder chamber 24 of the dual-action differential cylinder 7 is in each case impinged with pressure. In contrast, if the excavator arm 5 is to be pivoted down relative to the superstructure 2, only those pressurized lines 14 that lead to the respective rod-proximal cylinder chamber 15 of the dual-action differential cylinder 7 and of the single-action differential cylinder 8 are impinged with pressure. The diagram according to FIG. 7 thus corresponds to the exemplary embodiment according to FIGS. 3 and 5 of the invention. In contrast, in the exemplary embodiment according to FIGS. 4 and 6, only the base-proximal cylinder chamber 24 of the single-action differential cylinder 8 conjointly with the rod-proximal cylinder chamber 15 of the dual-action differential cylinder 7 would be impinged when pivoting down the excavator arm 5. Deviating from FIG. 7, in this variant the pressurized line 14 would thus lead to the base-proximal cylinder chamber 24 of the single-action differential cylinder 8, while the rod-proximal cylinder interior 15 of the latter by a corresponding ventilation opening 25 would be connected to the environment. The variant schematically illustrated in FIG. 7 is in any case a variant in which the single-action differential cylinder 8 when pivoting the excavator arm 5 down relative to the superstructure 2, for supporting the dual-action differential cylinder 7, is always impinged with pressure. In these variants, the forces required for pivoting down the excavator arm 5 are thus always made available conjointly by the dual-action differential cylinder 7 and the single-action differential cylinder 8.

This is not the case in the variant according to FIG. 8. This here is an exemplary embodiment in which it is provided that the walking excavator 1 has a regulator valve 12 which is actuated as a function of a pressure value measured by a pressure sensor 11 and by way of which the single-action differential cylinder 8 when pivoting the excavator arm 5 down relative to the superstructure 2, for supporting the dual-action differential cylinder 7, is able to be selectively impinged with pressure as a function of the measured pressure value. In such design embodiments, the single-action differential cylinder 8 thus supports the dual-action differential cylinder 7 when pivoting down the excavator arm 5 only when the pressure value measured by the pressure sensor 11 is above a pre-definable threshold value. Only then is the corresponding cylinder chamber 15 of this single-action differential cylinder 8 impinged with pressure by way of the corresponding pressurized line 14. The rod-proximal cylinder interior 15 as well as the base-proximal cylinder chamber 24 of the single-action differential cylinder 8 can be used also in the variant according to FIG. 8, depending on whether the single-action differential cylinder 8 is disposed on the lower side 9 or the upper side 10 of the excavator arm 5.

In the variants of embodiment according to FIGS. 7 and 8, a so-called high pressure circuit 13 can in each case be conjointly integrated, as is schematically indicated in the figures. In this instance, it can be provided in both variants that the walking excavator 1 has a high pressure circuit 13 which is actuated as a function of a pressure value measured by a or the pressure sensor 11 and by way of which the dual-action differential cylinder 7, and preferably also the single-action differential cylinder 8, when pivoting the excavator arm 5 down relative to the superstructure 2 as a function of the measured pressure value is/are able to be impinged with a pressure that is increased in comparison to a normal pressure level.

The pressure value which for activating the high pressure circuit 13 and/or for actuating the regulator valve 12 is measured by the pressure sensor 11 is favorably measured in one of the pressurized lines 14 which leads to a cylinder interior 15 of the dual-action differential cylinder 7 that is impinged for pivoting down the excavator arm 5.

LIST OF REFERENCE SIGNS

1 Walking excavator
2 Superstructure
3 Cab
4 Walking leg
5 Excavator arm
6 Excavating tool
7 Dual-action differential cylinder
8 Single-action differential cylinder
9 Lower side
10 Upper side
11 Pressure sensor
12 Regulator valve
13 High-pressure circuit
14 Pressurized line
15 Cylinder interior
16 Wheel
17 Excavator arm segment
18 Excavator arm segment
19 Pivot drive
20 Pivot drive
21 Piston
22 Piston rod
23 Cylinder
24 Cylinder chamber
25 Ventilation opening
26 Pressure control unit
27 Entire base area
28 Reduced piston area
29 Undercarriage

The invention claimed is:

1. A walking excavator, comprising
a superstructure;
an undercarriage;
a cab disposed on the superstructure;
four walking legs pivotably disposed on the undercarriage;
an excavator arm pivotably mounted on the superstructure and to which an excavating tool is fastened or fastenable;
a dual-action differential cylinder for pivoting the excavator arm up and down relative to the superstructure articulated on the superstructure on one side and on the excavator arm an other side; and
a single-action differential cylinder articulated on the superstructure on one side and on the excavator arm on an other side configured to apply additional force along with the dual-action differential cylinder when pivoting the excavator arm down relative to the superstructure.

2. The walking excavator as claimed in claim 1, wherein the single-action differential cylinder is configured to be impinged with pressure exclusively when pivoting the excavator arm down relative to the superstructure.

3. The walking excavator as claimed in claim 1, wherein the dual-action differential cylinder is disposed on a lower side of the excavator arm.

4. The walking excavator as claimed in claim 1, wherein the single-action differential cylinder is disposed on a lower side of the excavator arm.

5. The walking excavator as claimed in claim 1, wherein the single-action differential cylinder is disposed on an upper side of the excavator arm.

6. The walking excavator as claimed in claim 1, wherein the superstructure and the undercarriage are connected to one another by a continuously rotatable connection.

7. The walking excavator as claimed in claim 1, wherein the single-action differential cylinder is always impinged with pressure when pivoting the excavator arm down relative to the superstructure, to apply additional force along with the double-action differential cylinder.

8. The walking excavator as claimed in claim 1, further comprising a regulator valve which is actuated as a function of a pressure value measured by a pressure sensor and by which the single-action differential cylinder, when pivoting the excavator arm down relative to the superstructure to apply additional force along with the double-action differential cylinder, is configured to be selectively impinged with pressure as a function of the measured pressure value.

9. The walking excavator as claimed in claim 1, further comprising a high pressure circuit which is actuated as a function of a pressure value measured by a pressure sensor and by which the double-action differential cylinder when pivoting the excavator arm down relative to the superstructure as a function of the measured pressure value is able to be impinged with a pressure that is increased in comparison to a normal pressure level.

10. The walking excavator as claimed in claim 9, wherein the high pressure circuit is also configured to impinge the single-action differential cylinder with a pressure that is increased in comparison to the normal pressure level when pivoting the excavator arm down relative to the superstructure as a function of the measured pressure value.

11. The walking excavator as claimed in claim 9, wherein the pressure value measured by the pressure sensor is a pressure in a pressurized line which leads to a cylinder interior of the dual-action differential cylinder that is impinged for pivoting down the excavator arm.

12. The walking excavator as claimed in claim 1, wherein the single-action differential cylinder is exclusively impingeable with pressure only when pivoting the excavator arm down relative to the superstructure, to apply additional force along with the double-action differential cylinder.

* * * * *